US008398381B1

(12) United States Patent
Schumann

(10) Patent No.: US 8,398,381 B1
(45) Date of Patent: Mar. 19, 2013

(54) LOW FRICTION, HIGH FLOW PUMP

(76) Inventor: Laverne Schumann, Blue Grass, IA (US)

( * ) Notice: Subject to any disclaimer, the term of this patent is extended or adjusted under 35 U.S.C. 154(b) by 0 days.

(21) Appl. No.: 12/888,905

(22) Filed: Sep. 23, 2010

Related U.S. Application Data

(60) Provisional application No. 61/245,449, filed on Sep. 24, 2009.

(51) Int. Cl.
*F04B 17/00* (2006.01)

(52) U.S. Cl. ..... 417/410.4; 417/304

(58) Field of Classification Search ..... 418/190, 418/206.1, 206.6, 206.8, 206.4; 137/512.1; 417/304, 410.4
See application file for complete search history.

(56) References Cited

U.S. PATENT DOCUMENTS

| | | | | | |
|---|---|---|---|---|---|
| 1,795,579 | A * | 3/1931 | Storey | 418/77 |
| 2,287,318 | A * | 6/1942 | McIntyre | 418/74 |
| 2,641,192 | A * | 6/1953 | Lindberg | 417/283 |
| 2,704,035 | A * | 3/1955 | Bader | 417/504 |
| 2,816,513 | A * | 12/1957 | Watson | 418/169 |
| 3,053,191 | A * | 9/1962 | Weigert | 418/131 |
| 3,130,682 | A * | 4/1964 | Meads | 418/189 |
| 4,706,968 | A * | 11/1987 | Orlowski | 277/347 |
| 5,810,571 | A * | 9/1998 | Cross et al. | 418/47 |
| 5,825,110 | A * | 10/1998 | Page | 310/90 |
| 5,879,140 | A * | 3/1999 | Ellison | 417/310 |
| 2011/0014080 | A1 * | 1/2011 | Robillard | 418/205 |

* cited by examiner

*Primary Examiner* — Peter J Bertheaud
*Assistant Examiner* — Dnyanesh Kasture
(74) *Attorney, Agent, or Firm* — Hamilton IP Law, PC; Jay R. Hamilton; Charles A. Damschen

(57) ABSTRACT

One embodiment of the pump system includes a cover housing and a main body affixed to one another for operation. A drive and idler gear may be mounted within a gear chamber in the main body for rotation there about, and inlet fluid may be provided on both the axial and radial surfaces of the drive and idler gear. The cover housing may be outfitted with one pressure relief channel or with two pressure relief channels of different geometric sizes and with different actuation pressures. The drive and/or idler gear may have dimples fashioned on an axial surface thereof, and lubricant troughs may be fashioned at various locations in the main body and/or the cover housing to reduce wear within the pump.

11 Claims, 9 Drawing Sheets

LOW FRICTION, HIGH FLOW PUMP

CROSS REFERENCE TO RELATED APPLICATIONS

The present application claims the benefit of provisional U.S. Pat. App. Ser. No. 61/245,449 filed Sep. 24, 2009, which Applicant claims priority from and incorporates by reference herein its entirety.

FIELD OF INVENTION

This invention relates generally to pumps and equipment used therewith.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

BACKGROUND

Many internal combustion engine oil pumps are of the gear pump type wherein the drive gear is connected to the engine camshaft, or other rotational power source. The drive gear, in turn, rotates an idler gear, and the pump consists of a main body and cover housing, which are affixed to one another during use. Other engine oil pumps use a rotary gear set having a rotor gear and a stator ring gear. The cover housing may also include a relief valve. An oil inlet or "pick-up tube" is often mounted on the cover housing and is located within the engine pan sump, permitting oil to be drawn into the pump from the crank case.

In high performance engines such as those used in race cars, the high engine RPM causes rapid wear in the oil pump, as such pumps are built to close tolerances in order to achieve the high oil flow necessary to lubricate the rapidly rotating engine. Conventional internal combustion engine oil pumps utilize a drive shaft, driven from the engine camshaft or ignition distributor, and a driven gear is mounted upon the lower end of the drive shaft.

BRIEF DESCRIPTION OF THE FIGURES

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limited of its scope, the invention will be described and explained with additional specificity and detail through the use of the accompanying drawings.

DETAILED DESCRIPTION

Listing of Elements

Figure 1:
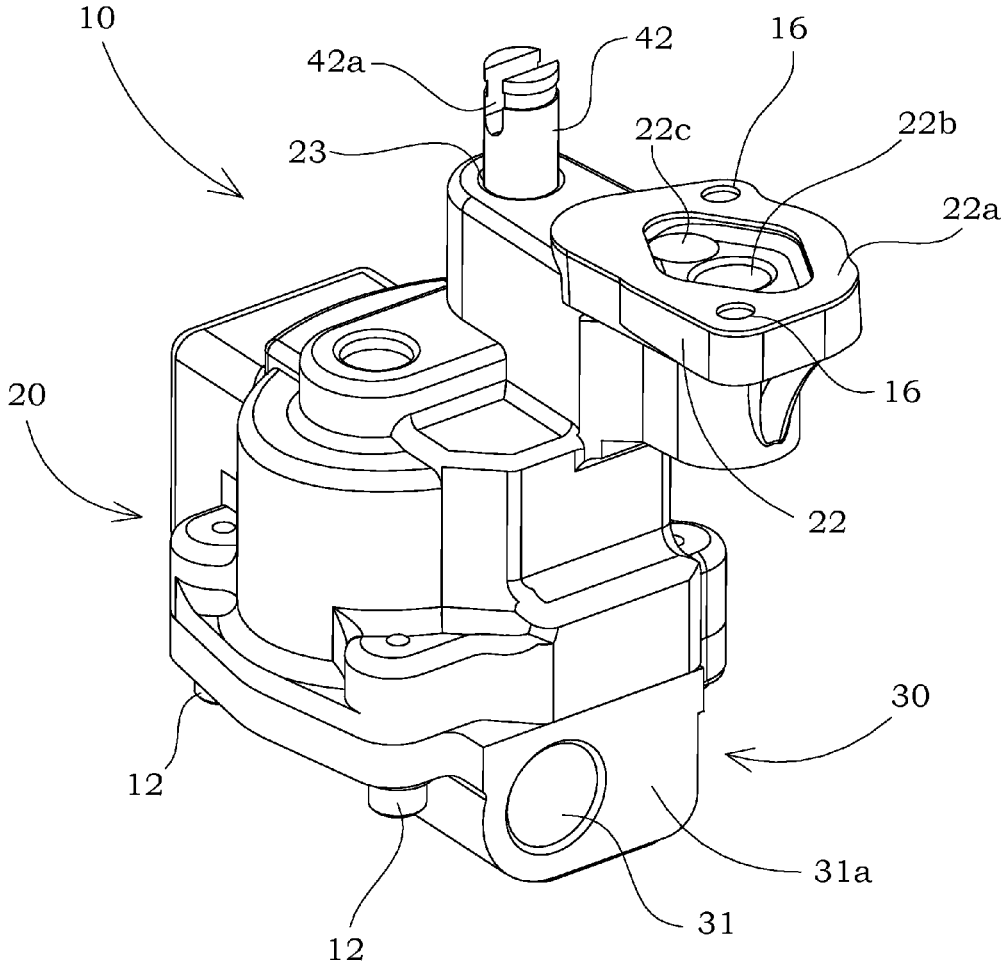
FIG. 1 provides a perspective view of one embodiment of a pump constructed according to the present disclosure.

| ELEMENT DESCRIPTION | ELEMENT # |
|---|---|
| Pump | 10 |
| Fastener | 12 |
| Diffuser screen | 14 |
| Aperture | 16 |
| Main body | 20 |
| Mounting base | 22 |
| Outlet interface | 22a |
| Mounting passage | 22b |
| Pump outlet port | 22c |
| Pump outlet passage | 22d |
| Drive gear shaft bore | 23 |
| Chamfer relief | 23a |
| Drive gear shaft bore groove | 23b |
| Cover housing interface surface | 24 |
| Gear chamber | 25 |
| Radial inlet port | 26 |
| Radial inlet port passage | 26a |
| Oil feed drive gear trough | 27a |
| Oil feed idler gear trough | 27b |
| Axial gear interface surface | 28a |
| Radial gear interface surface | 28b |
| Idler gear shaft | 29 |
| Cover housing | 30 |
| Inlet channel | 31 |
| Pick-up tube interface | 31a |
| Anitcavitation groove | 32 |
| Main body interface surface | 33 |
| Pressure relief inlet cavity | 34 |
| Pressure relief inlet | 34a |
| Pressure relief retainer channel | 34c |

-continued

| ELEMENT DESCRIPTION | ELEMENT # |
|---|---|
| Pressure relief inlet cavity trough | 34d |
| Pressure relief outlet | 35 |
| Axial inlet port | 36 |
| Radial inlet port feed passage | 36a |
| Drive gear | 40 |
| Drive gear shaft | 42 |
| Drive gear shaft connector | 42a |
| Drive gear shaft lower end | 42b |
| Drive gear tooth | 44 |
| Drive gear tooth dimple | 46 |
| Idler gear | 50 |
| Idler gear tooth | 54 |
| Idler gear tooth dimple | 56 |
| Spring | 62 |
| Valve | 64 |
| Spring connector | 66 |
| Spring retainer | 68 |
| First pressure relief channel | 72 |
| Cross channel | 73 |
| Second pressure relief channel | 74 |
| Rotary pump | 80 |
| Rotary gear set | 81 |
| Rotor gear | 82 |
| Rotor dimple | 82a |
| Rotor groove | 83 |
| Stator ring gear | 84 |
| Stator dimple | 84a |
| Stator groove | 85 |
| Stator radial bore | 86 |

DETAILED DESCRIPTION

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

Figure 2:
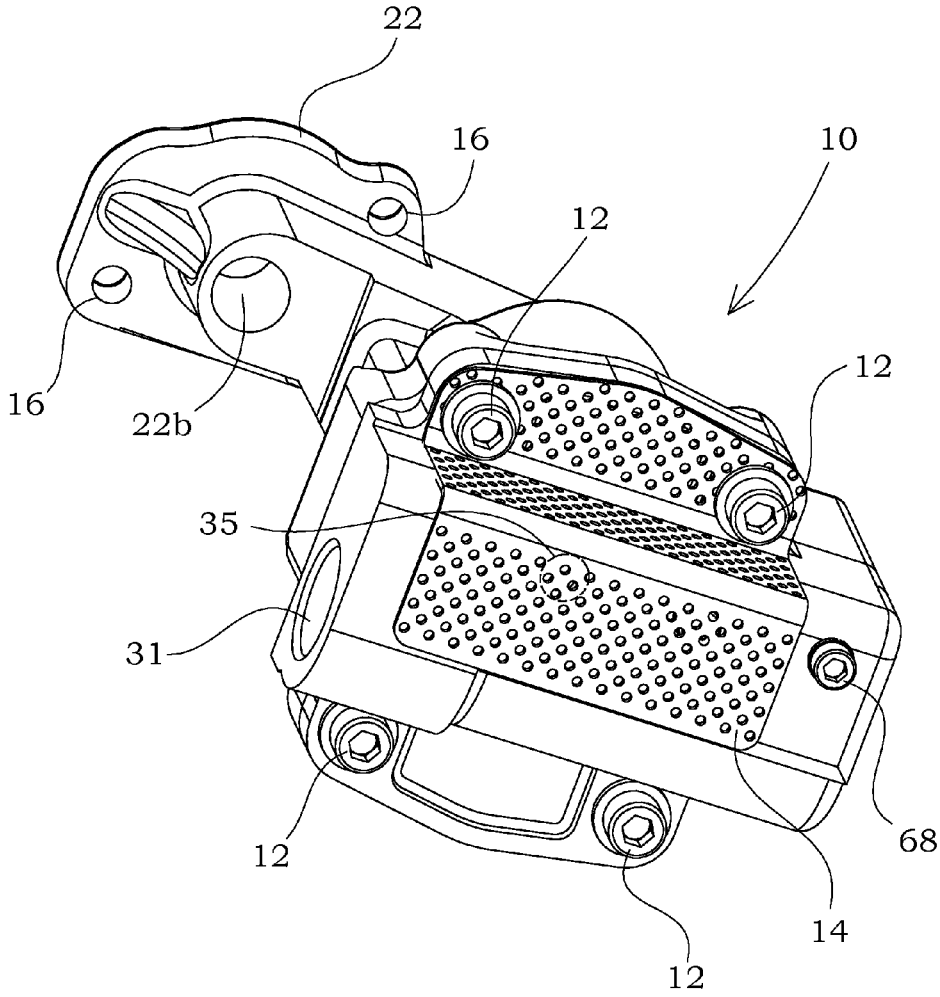
FIG. 2 provides a bottom perspective view of one embodiment of a pump constructed according to the present disclosure.

Referring now to the drawings, wherein like reference numerals designate identical or corresponding parts throughout the several views, FIG. 1 provides elevated perspective view of one embodiment of a pump 10 and/or pump system, and FIG. 2 shows a bottom perspective view thereof. The pump 10 is generally comprised of a main body 20 and a cover housing 30, which are fastened to one another via a plurality of fasteners 12 during use. The specific embodiments of pumps 10 and/or pump systems pictured herein are designed for use as an oil pump for an internal combustion engine. However, several aspects of pumps 10 and/or components thereof may be used with other types of pumps 10, and accordingly, the present disclosure is not limited to a specific type of pump 10 and/or pump system or applications thereof.

Figure 4:
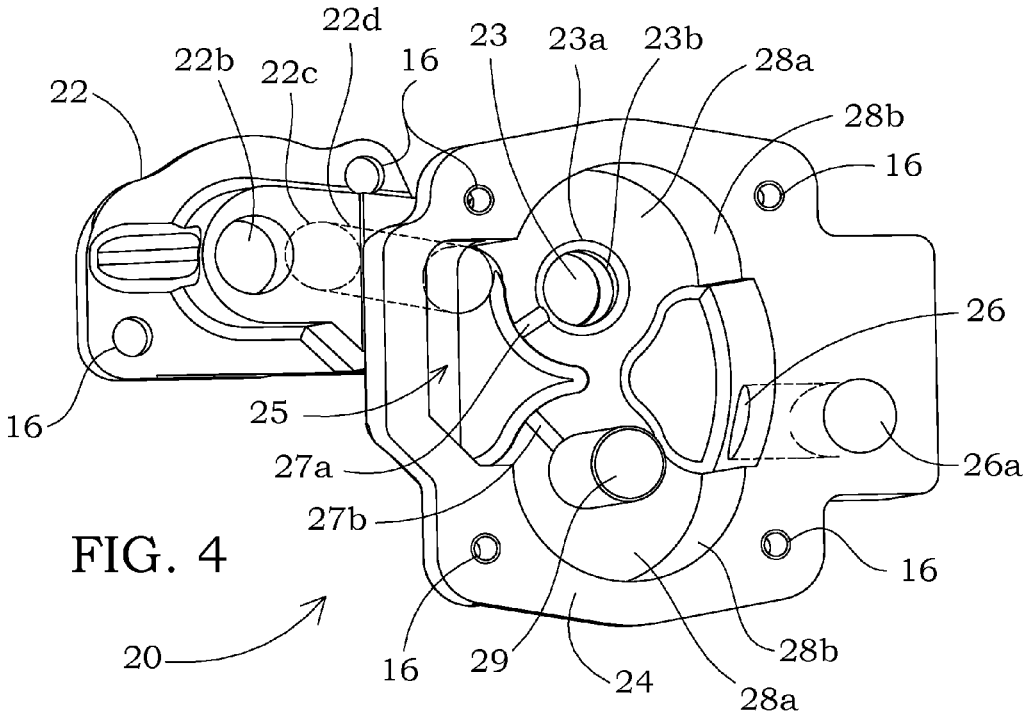
FIG. 4 provides a detailed view of the internal side of one embodiment of a main body constructed according to the present disclosure.

The internal portion of the main body 20 for one gear-to-gear embodiment of the pump 10 is shown in FIG. 4. Referring now to FIGS. 1, 2, and 4, it will be seen that in this embodiment a mounting base 22 extends from the main body. In the embodiment of the pump 10 pictured herein, the mounting base 22 serves to mount the pump 10 to a secure structure, which is typically the engine block of an internal combustion engine in a manner similar to that disclosed in U.S. Pat. No. 3,057,434, which is incorporated by reference herein in its entirety. In such pumps 10 an outlet interface 22*a* may be fashioned in the mounting base 22 to provide an interface between the pump 10 and the structure to which the pump 10 is mounted. The outlet interface 22*a* in the embodiment of the main body 20 pictured herein surrounds a pump outlet port 22*c* through which pressurized fluid exits the main body 20. The pump outlet port 22*c* is fluidly connected to the gear chamber 25 via a pump outlet passage 23 (shown in FIG. 4) fashioned as an internal channel in the main body 20 and may be formed in a portion of the mounting base 22.

A mounting passage 22*b* may be fashioned in the mounting base 22 to provide for a fastener 12 that engages both the pump 10 and the structure to which the pump 10 is mounted. In the particular embodiment pictured herein, a pump outlet port 22*c* is positioned within the periphery of the outlet interface 22*a* and adjacent the mounting passage 22*b*. The pump outlet port 22*c* is in fluid communication with a pump outlet passage 22*d* formed in the main body 20, which pump outlet passage 22*d* is in fluid communication with the gear chamber 25 of the main body 20 as previously described. Other mounting methods and/or structures may be used for the pump 10 according to the present disclosure. Accordingly, the scope of the pump 10 as disclosed and claimed herein is not limited by the particular mounting method and/or structure used to mount the pump 10 and/or pump system.

A gasket (not shown) may be positioned between the outlet interface 22*a* and the structure to which the pump 10 is mounted. A copper gasket may be especially useful for sealing the outlet interface 22*a* and the structure to which the pump 10 is mounted because it is malleable enough that the copper gasket material will form to imperfections in either the outlet interface 22*a* and/or structure to which the pump 10 is mounted, yet the copper gasket resists degradation due to heat and/or pressure because of the intrinsic properties of copper. A copper gasket may be configured for use with any embodiment of a pump, including the pump 10 shown in FIG. 1 and the rotary pump 80 shown in FIG. 7A. It is contemplated that the periphery of a copper gasket configured for the pump 10 shown in FIG. 1 will follow the shape and dimensions of the outlet interface 22*a*. However, the copper gasket may be used with any outlet interface 22*a*, and therefore the size and/or dimensions thereof are in no way limiting to the scope of the copper gasket.

The internal portion of the main body 20 includes a gear chamber 25, which is best shown in FIG. 4. A cover housing interface surface 24 surrounds the periphery of the gear chamber 25 and provides a surface for sealing the main body 20 to the cover housing 30. In the pictured embodiment, four apertures 16 are fashioned in the main body 20 at various positions around the cover housing interface surface 24. The four apertures 16 in the main body 20 correspond to four apertures 16 in the cover housing 30 (best shown in FIGS. 3A and 3B), and four fasteners 12. The fasteners 12 may be configured as bolts in the embodiment pictured herein, and may be inserted into the corresponding apertures 16 in the main body 20 and the cover housing 30 to secure the main body 20 and the cover housing 30 to one another. Other types of fasteners may be used without limitation.

Sealing material, such as a gasket, o-ring linelar, or silicon rubber, may be placed between the main body 20 and the cover housing 30 at the cover housing interface surface 24 to enhance the seal there between. If an o-ring (not shown) is used, the cover housing interface surface 24 and/or main body interface surface 33 may be formed with a groove (not shown) therein that is shaped similarly to the periphery of the main body 20, into which groove the o-ring may seat. The groove may be curved or square in cross-sectional shape and the cross-sectional shape of the o-ring may compliment that of the groove.

Figure 5A:
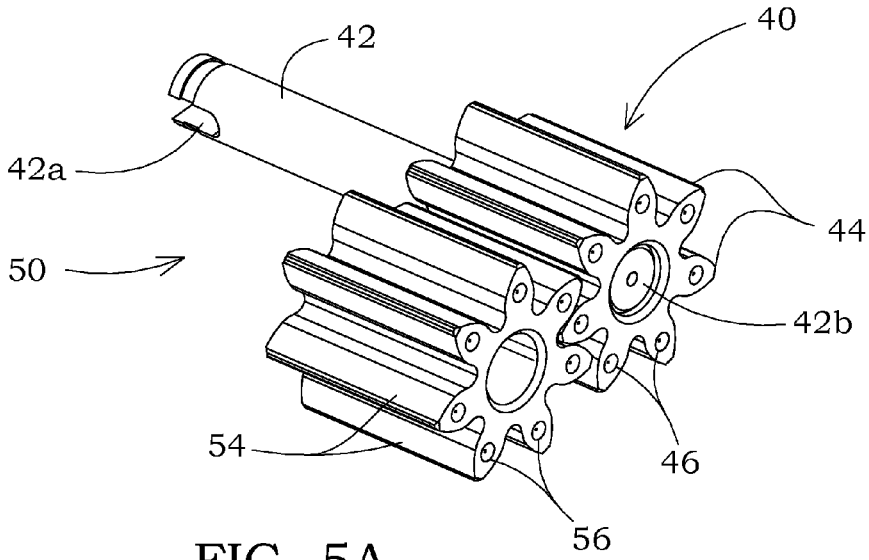
FIG. 5A provides a perspective view of one embodiment of a drive gear and idler gear constructed according to one aspect of the present disclosure.
Figure 5B:
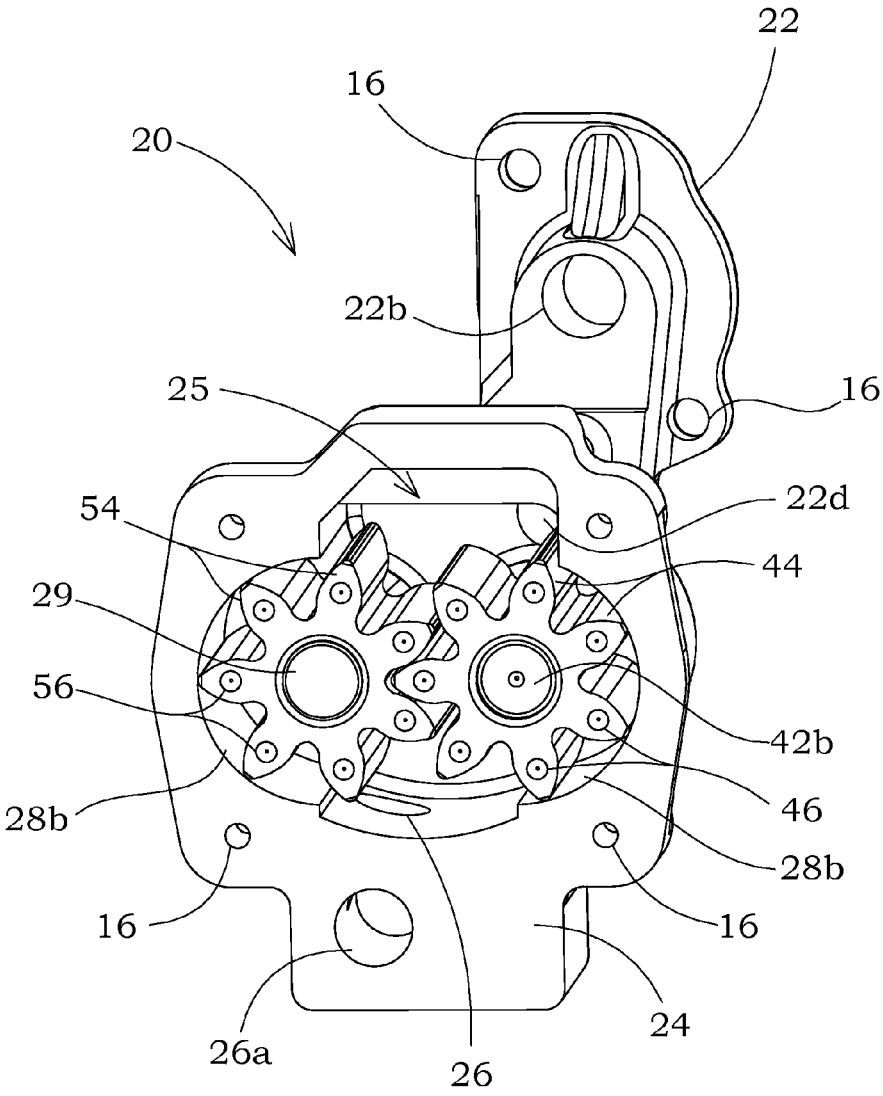
FIG. 5B provides a perspective view of one embodiment a drive gear and idler gear constructed according to one aspect of the present disclosure positioned in one embodiment of a main body.
Figure 6A:
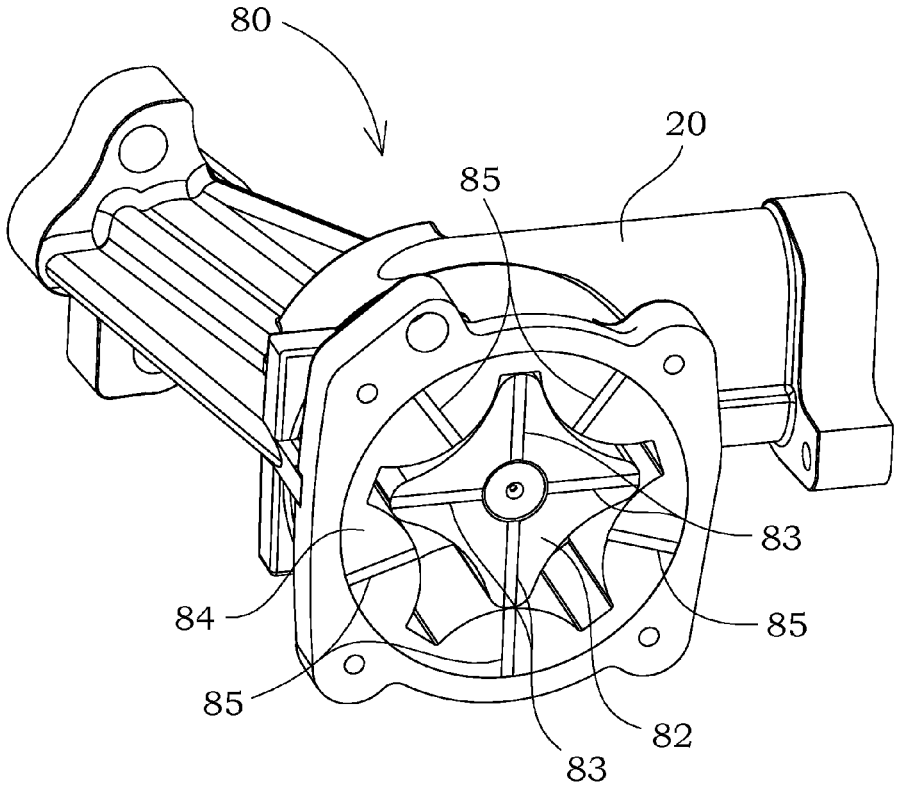
FIG. 6A provides a perspective view of a first embodiment of a rotary pump gear set constructed according to one aspect of the present disclosure positioned in one embodiment of a main body.
Figure 6B:
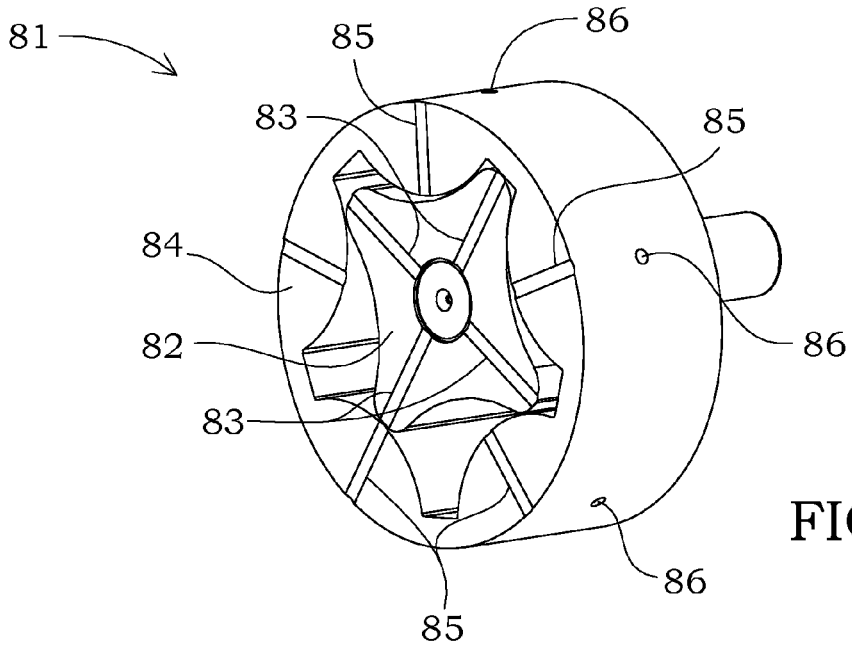
FIG. 6B provides a perspective view of the first embodiment of a rotary pump gear set constructed according to one aspect of the present disclosure.
Figure 6C:
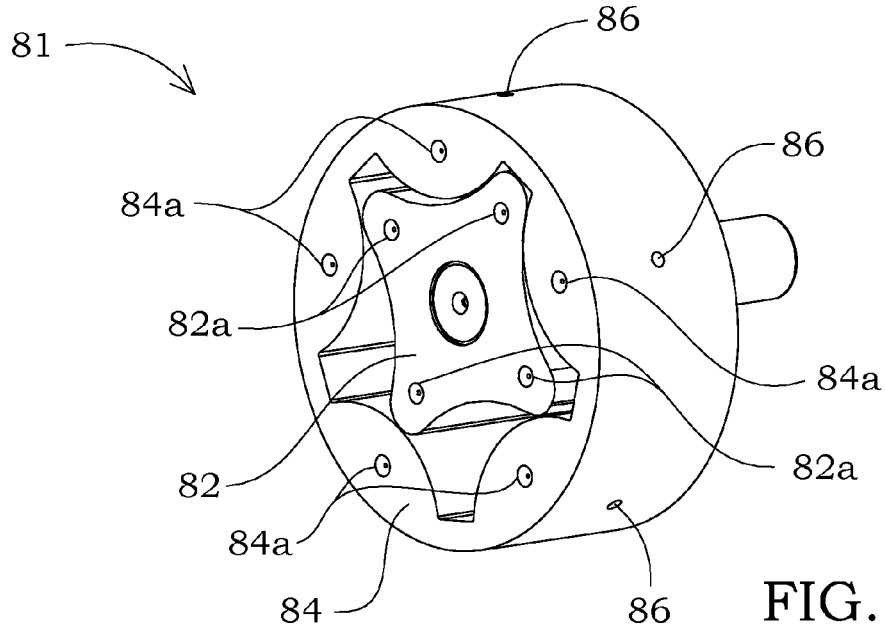
FIG. 6C provides a perspective view of a second embodiment of a rotary pump gear set constructed according to one aspect of the present disclosure.

A drive gear 40 and an idler gear 50, such as those shown in FIG. 5A, may be positioned in the gear chamber 25 (as shown in FIG. 5B) to energize fluid positioned in the gear chamber 25. A drive gear shaft 42 may be fixedly attached to the drive gear 40. The drive gear shaft 42 is disposed in the drive gear shaft bore 23 when the pump 10 is assembled. The drive gear shaft 42 includes a drive gear shaft connector 42*a* on the upper end thereof, which protrudes from the main body 20 as shown in FIG. 1. A rotational power source (not shown) may be operatively engaged with the drive gear shaft 42 at the drive gear shaft connector 42*a*. The drive gear shaft lower end 42*b* is positioned adjacent an axial face of the drive gear 40 as shown in FIG. 5B. As will be apparent to those skilled in the art in light of the present disclosure, as the drive gear 40 rotates, the intermeshing of the drive gear teeth 44 with the idler gear teeth 54 causes the idler gear 50 to rotate in a direction opposite to that of the drive gear 40. The idler gear 50 may be disposed for pivotal engagement with an idler gear shaft 29, which idler gear shaft 29 may be rigidly mounted to the main body 20 as shown in FIG. 4. In other embodiments of the pump 10 not pictured herein (such as that disclosed in U.S. Pat. No. 5,810,571, which is incorporated by reference herein in its entirety) the idler gear shaft 29 is pivotally mounted to the main body 20 and the idler gear 50 is fixedly mounted to the idler gear shaft 29.

Referring now to FIG. 4, one axial surface of the drive gear 40 interfaces the main body 20 at the axial gear interface surface 28*a* adjacent the drive gear shaft bore 23, and one axial surface of the idler gear 50 interfaces the main body 20 at the axial gear interface surface 28*a* adjacent the idler gear shaft 29. The radial surface of the drive gear 40 interfaces the main body 20 at the radial gear interface surface 28*b* adjacent the drive gear shaft bore 23, and the radial surface of the idler gear 50 interfaces the main body 20 at the radial gear interface surface 28*b* adjacent the idler gear shaft 29. An oil feed drive gear trough 27*a* and an oil feed idler gear trough 27*b* may be positioned in the respective axial gear interface surfaces 28*a* to allow oil positioned in the gear chamber 25 to migrate between one axial surface of the drive gear 40 and idler gear 50 and the main body 20.

In one embodiment of the main body 20, a chamfer relief 23*a* is fashioned in the drive gear shaft bore 23 adjacent the axial gear interface surface 28*a*, which is shown in FIG. 4. The chamfer relief 23*a* allows oil positioned in the gear chamber 25 to migrate into the drive gear shaft bore 23 and subsequently lubricate the interface between the outer surface of the drive gear shaft 42 and the drive gear shaft bore 23. For even further lubrication, a drive gear shaft bore groove 23*b* may be fashioned in the drive gear shaft bore 23. In the embodiment shown in FIG. 4, the drive gear shaft bore groove 23*b* is formed primarily as a continuous spiral groove or rifling along the length of the drive gear shaft bore 23. This allows oil located in the gear chamber 25 to migrate from the interior end of the drive gear shaft bore 23 (adjacent the drive gear 40) to the exterior of the main body 20 (adjacent the drive gear shaft connector 42*a*), thereby lubricating the entire interface between the drive gear shaft 42 and drive gear shaft bore 23. In other embodiments not pictured herein, the drive gear shaft bore groove 23*b* may consist of a plurality of continuous grooves along the length of the drive gear shaft bore 23 or a portion thereof.

The main body 20 may be formed with a radial inlet port 26 adjacent the two radial gear interface surfaces 28*b* as best shown in FIG. 4. The radial inlet port 26 is in fluid communication with a radial inlet port passage 26*a* formed in the main body 20. The radial inlet port passage 26*a* extends to the cover housing interface surface 24 where it interfaces and is in fluid communication with a radial inlet port feed passage 36*a* formed in the cover housing 30, which is described in detail below. The radial inlet port 26 provides fluid to the inlet portion of the gear chamber 25 along the radial surface of the drive and idler gears 40, 50, which allows the pump 10 to achieve a higher volumetric flow rate than the same pump 10 not configured with a radial inlet port 26. Testing has shown an increased volumetric flow rate of approximately forty percent (40%) in pumps 10 fashioned with a radial inlet port passage 26*a* compared to pumps 10 not having a radial inlet port passage 26*a*, but otherwise identical.

Figure 3A:
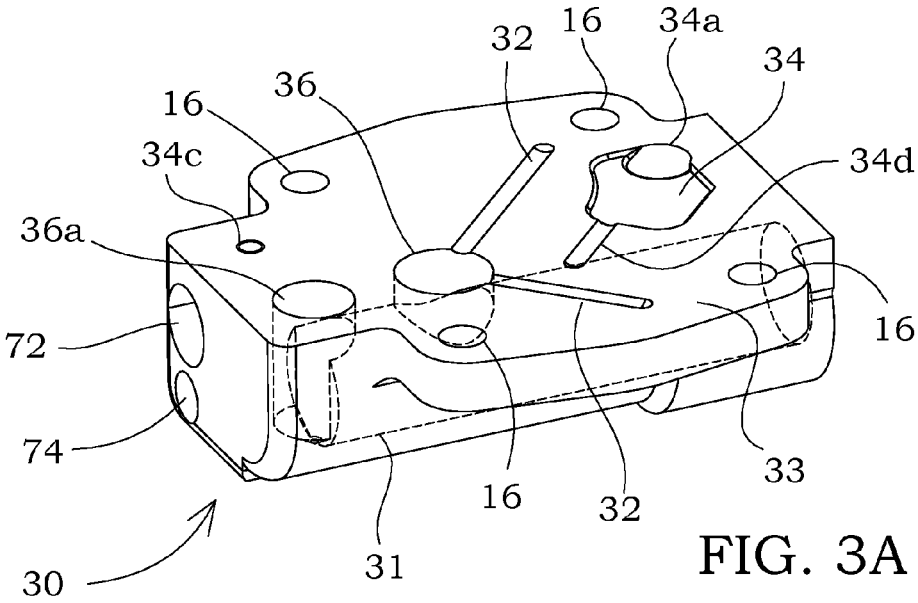
FIG. 3A provides a detailed side view of the internal side of one embodiment of a cover housing constructed according to the present disclosure.
Figure 3B:
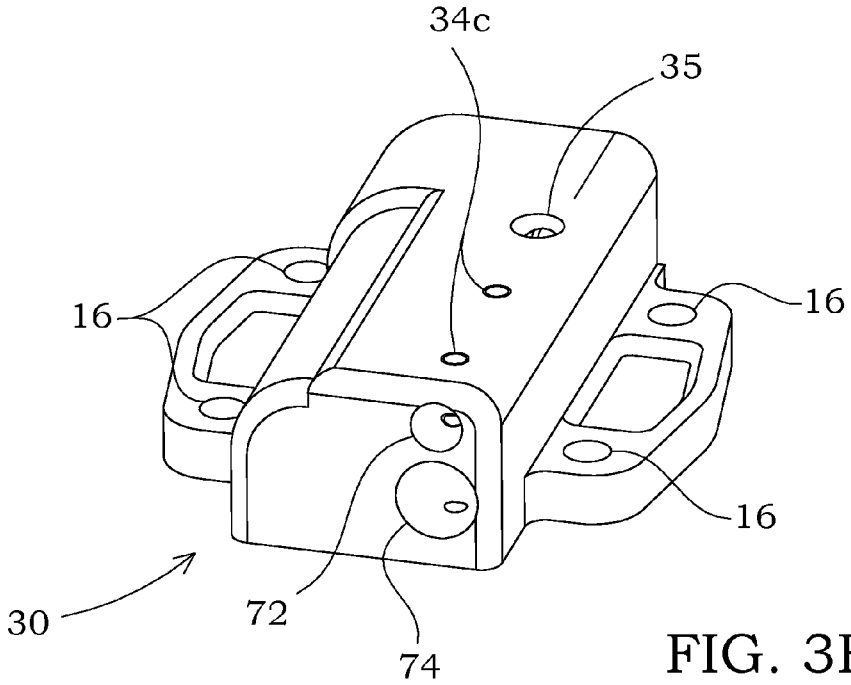
FIG. 3B provides a detailed perspective view of the external surface of one embodiment of a cover housing constructed according to the present disclosure.

A detailed view of the internal surface of the cover housing 30 is shown in FIG. 3A, and a detailed view of the external surface thereof is shown in FIG. 3B. The portion of the internal surface of the cover housing 30 that contacts the main body 20 is referred to as the main body interface surface 33 and may be essentially a mirror image of the cover housing interface surface 24. An inlet channel 31 is formed in the cover housing 30, the external portion of which may be formed as a pick-up tube interface 31*a* (best shown in FIGS. 1 and 2). Supply fluid is provided to the pump 10 via the inlet channel 31, which supply fluid may be oil from an oil sump located within an internal combustion engine.

Referring now to FIG. 3A, an axial inlet port 36 is in fluid communication with the inlet channel 31 and provides inlet fluid to the axial surface of the drive and idler gears 40, 50 when the pump 10 is assembled. A plurality of anticavitation grooves 32 may extend from the axial inlet port 36 to supply fluid to the axial surface of the drive and idler gears 40, 50 adjacent the cover housing 30 and to ensure that the pump 10 does not cavitate in situations of changing flow rates and/or pressures. A radial inlet port feed passage 36*a* may be fashioned in the main body interface surface 33, which radial inlet port feed passage 36*a* corresponds to the radial inlet port passage 26*a* formed in the cover housing interface surface 24 of the main body 20. Accordingly, supply fluid may pass from the pick-up tube interface 31*a* through the inlet channel 31 to the radial inlet port feed passage 36*a* in the cover housing 30 to the radial inlet port passage 26*a* in the main body and through the radial inlet port 26 to the gear chamber 25 in the main body 20 and encounter the drive and idler gears 40, 50 on the radial surface thereof. Additionally, supply fluid may pass from the pick-up tube interface 31*a* through the inlet channel 31 to the axial inlet port 36 in the cover housing 30 and encounter the drive and idler gears 40, 50 on an axial surface thereof such that the drive and idler gears 40, 50 are supplied with fluid from two distinct surfaces and/or sources for increased volumetric flow of the pump 10.

Figure 3C:
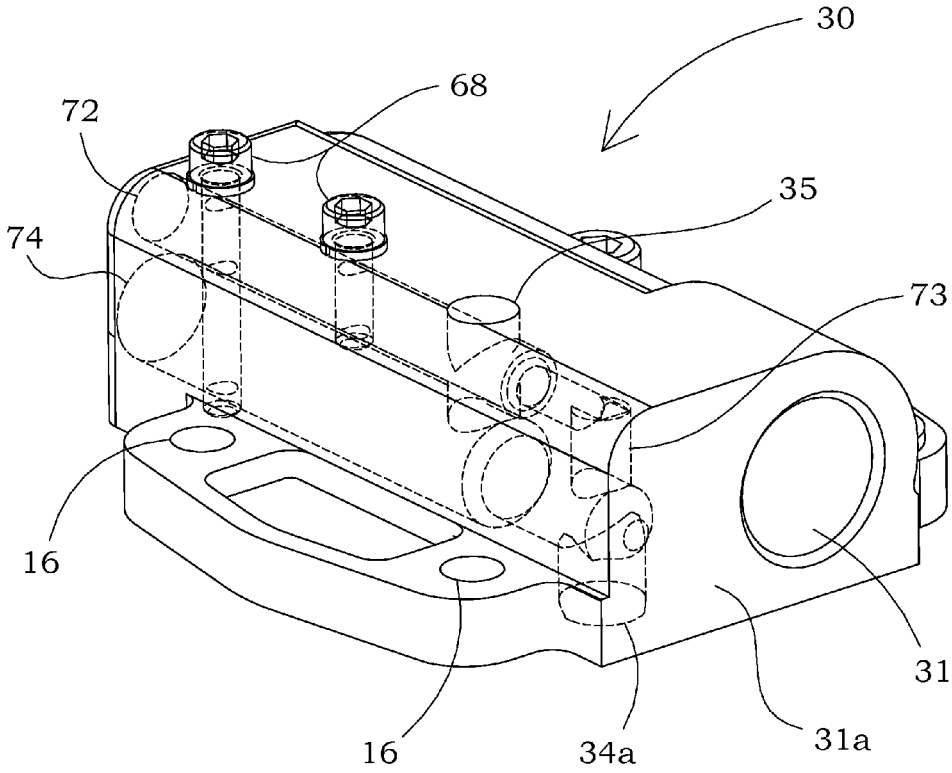
FIG. 3C provides a detailed view of one embodiment of a cover housing showing various internal elements as hidden lines.

The cover housing 30 also may be formed with a pressure relief inlet cavity 34 opposite the radial inlet port feed passage 36*a*. A plurality of pressure relief inlet cavity troughs 34*d* may extend from the pressure relief inlet cavity 34 to provide fluid to the axial surface of the drive and idler gears 40, 50 adjacent the cover housing 30 and to direct pressurized fluid within the gear chamber 25 to the pressure relief inlet 34*a*. A pressure relief inlet 34*a* may be positioned adjacent the pressure relief inlet cavity 34 for fluid communication with a first pressure relief channel 72. In one embodiment of the cover housing 30 the first pressure relief channel 72 is oriented parallel to the inlet channel 31, as best shown in FIG. 3C, which shows various internal elements of one embodiment of a cover housing 30 as hidden lines, and in which certain mechanical elements have been removed for purposes of clarity. The first pressure relief channel 72 may extend through the exterior wall of one side of the cover housing 30 as shown in FIGS. 3A and 3B, but one end of the first pressure relief channel 72 may be sealed. A pressure relief outlet 35 may be fashioned in the side of the cover housing 30 so that it is in fluid communication with the pressure relief channel 34*b* during predetermined conditions of sufficient pressure within the gear chamber 25.

One or more pressure relief retainer channels 34*c* may be fashioned to intersect the pressure relief channel 34*b* and engage a spring retainer 68, which is described in detail below. In the embodiments pictured herein, the spring retainer 68 is threaded to engage a tapped pressure relief retainer channel 34*c*. However, in other embodiments the spring retainer 68 and/or pressure relief retainer channel 34*c* are smooth or are engaged with one another using a structure and/or method other than threads. Accordingly, the spring retainer 68 may be engaged with the cover housing 30 through any method and/or structure known to those skilled in the art without limitation.

Figure 3D:
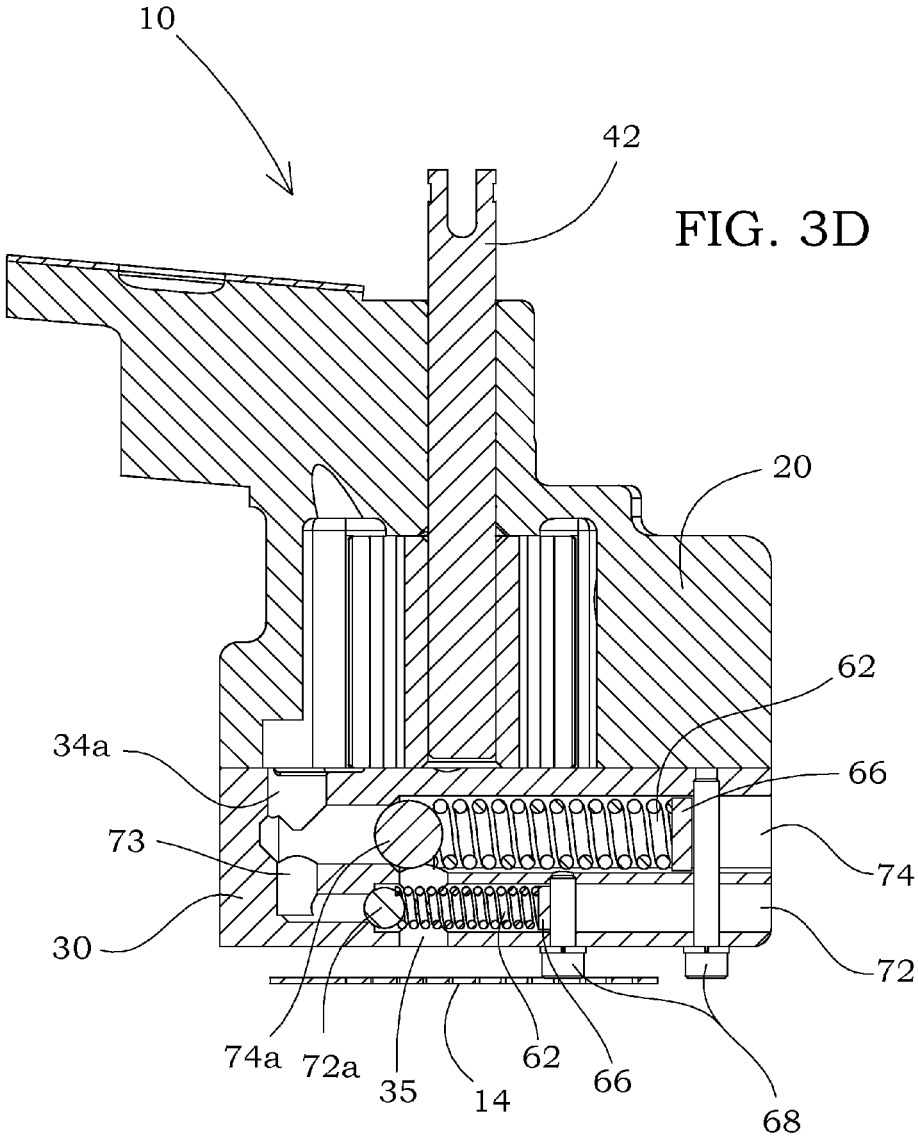
FIG. 3D provides a detailed cross-sectional view of one embodiment of a pump constructed according to the present disclosure.

A pressure relief assembly comprising a spring 62, valve 64, and spring connector 66 (as shown in FIG. 3D, which provides a cross-sectional view of one embodiment of the pump 10) may be engaged with one of the pressure relief channels 72, 74 of the cover housing 30 to allow pressurized fluid to be expelled from the gear chamber 25 via a conduit other than the pump outlet passage 22*d* upon certain predetermined conditions. Generally, the spring 62, valve 64, and spring connector 66, may be disposed in the first pressure relief channel 72 and sized such that when the pump 10 is operating in a desired differential pressure range, the valve 64 prevents pressurized fluid within the gear chamber 35 from exiting through the pressure relief outlet 35. The valve 64 is positioned adjacent the pressure relief outlet 35, followed by the spring 62 and the spring connector 66. The spring retainer 68 in conjunction with the spring 62 and spring connector 66 may serve to bias the valve in a direction toward the pressure relief outlet 35.

In the embodiments pictured herein, the spring retainer 68 is fashioned as a bolt, but may be any structure known to those skilled in the art that is suitable for the particular application of the pump 10 and/or pump system. The amount of force by which the spring 62 resists compression determines the pressure within the gear chamber 25 that will cause the valve 64 to open and allow pressurized fluid to exit the gear pump 10 via the pressure relief outlet 35. In the embodiments pictured herein, it is contemplated that the spring connector 66 may be fashioned as a washer, solid plate, or otherwise. These spring connectors 66 may serve as shims so that the assembly height of the pressure relief assembly 60 may be fine tuned for optimal performance thereof.

In certain embodiments it may be beneficial to offer a plurality of springs 62 of differing resistance so that the pressure at which the pressure relief assembly allows fluid to exit the main body 25 through the pressure relief outlet 35 may be adjusted by the user. The different springs 62 may be color-coded to correspond to a specific relief pressure. The spring 62 may be removed by disengaging the spring retainer 68 from the pressure relief retainer channel 34*c* and removing the spring connector 66 (best shown in FIG. 3D) to access the spring 62. A diffuser screen 14 may be positioned over the pressure relief outlet 35, as shown in FIG. 2, so that when the valve 64 opens, the exiting fluid is disbursed in a wide spray pattern rather than a concentrated stream.

In the various embodiments pictured herein, the valve 64 in the pressure relief assembly 60 is fashioned as a ball valve 64, which is best shown in FIG. 3D. Typical prior art valves 64 are fashioned as plug, cup, or spool valves. The ball valve 64 typically provides superior performance to other types of valves 64 in the presence of any foreign objects, which is common in motor oil applications of internal combustion engines. For example, if a piece of foreign material, such as carbon or paper, encounters the surface of the ball valve 64, the ball may rotate about the end of the spring 62 and/or pressure relief outlet 35 until the foreign material is expelled. Furthermore, the rotation of the ball against the pressure relief outlet 35 may fragment the piece of foreign material or dislodge it from the surface of the ball valve 64. Conversely, because of the leverage on a cylinder-shaped plug, a piece of foreign material positioned on a plug valve 64 often causes the valve 64 to stick in one position and malfunction. This problem is exacerbated by the closer tolerances required between the valve 64 and the pressure relief channel 34*b*, which may be as little as two thousands of an inch.

The embodiment of the cover housing 30 shown herein also includes a second pressure relief channel 74 fashioned therein and in fluid communication with the pressure relief inlet 34*a*, although other embodiments may include only a first pressure relief channel 72. A pressure relief assembly analogous to that described above may be positioned in the second pressure relief channel 74. The two pressure relief assemblies may be sized differently volumetrically (e.g., the diameter of the first and second pressure relief channels 72, 74 may be different, as in the embodiment shown) and the springs 62 in each pressure relief assembly may be sized so that the respective valves 64 require different internal pressures in the pump 10 before the respective valve 64 opens.

The first and second pressure relief channels 72, 74 are in fluid communication via a cross channel 73 that extends from the first pressure relief channel 72 and into the second pressure relief channel 74. In this embodiment the pressure relief outlet 35 may be in fluid communication with both pressure relief channels 72, 74, as best shown in FIG. 3D. Each pressure relief channel 72, 74 may have separate and distinct pressure relief outlets 35, or the two pressure relief channels 72, 74 may share a common pressure relief outlet 35.

As is clearly shown in FIG. 3D, the cross-sectional area of the second pressure relief channel 74 is greater than that of the first pressure relief channel 72 by approximately thirty-five percent, but may be different in other embodiments of the cover housing 30 not pictured herein. The first and second pressure relief channels 72, 74 are shown with each having a valve 64 positioned within the respective pressure relief channels 72, 74 in FIG. 3D. It should be noted that during operation the end of the pressure relief channels 72, 74 visible in FIG. 3B would likely be sealed.

It is contemplated that the spring 60 associated with the first pressure relief channel 72 will bias the valve 64 associated therewith by a lesser amount than the amount with which the spring 60 associated with the second pressure relief channel 74 biases the valve 64 associated therewith. That is, less pressure within the pump 10 will be required to open the valve in the first pressure relief channel 72 than the pressure required to open the valve in the second pressure relief channel 74. Because the cross-sectional area of the first pressure relief channel 72 is less than that of the second pressure relief channel 74, a lower volume of pressurized fluid will exit the pump 10 when the valve 64 in the first pressure relief channel 72 is open than when the valve 64 in the second pressure relief channel 74 is open. Accordingly, with properly sized first and second pressure relief channels 72, 74 and springs 62 placed therein, the pump 10 will not be forced to operate with insufficient fluid therein, which typically occurs when a larger valve 64 opens with the engine running at idle or close to idle speeds. Such operating conditions often occur with prior art pumps due to the large volume of pressurized fluid that exits the pump 10 when a pressure bypass valve is opened.

In one embodiment of the cover housing 30 having two pressure relief channels 72, 74, the valve 64 associated with the first pressure relief channel 72 and associated components are sized and configured so that that valve 64 is sensitive to pressures indicative of idle engine speeds for an internal combustion engine and also configured for optimal performance with volumetric flow rates typical of idle engine speeds (2-3 gallons per minute (GPM)). The valve 64 associated with the second pressure relief channel 74 and associated components are sized and configured so that that valve 64 is sensitive to pressures indicative of higher engine speeds and also configured for optimal performance with volumetric flow rates typical of higher engine speeds (4-16 GPM).

The drive and idler gears 40, 50 shown in FIGS. 5A and 5B are each fashioned with an equal number of drive gear and idler gear teeth 44, 54. As is readily apparent, the axial surface of the drive gear 40 visible in FIGS. 5A and 5B (which is the surface of the drive and idler gears 40, 50 that is adjacent the cover housing 30 when the pump 10 is assembled) includes a drive gear tooth dimple 46 in each drive gear tooth 44. Similarly, the visible axial surface of the idler gear 50 includes an idler gear tooth dimple 56 in each idler gear tooth 54. The drive and idler gear tooth dimples 46, 56 provide a pocket for lubricant to migrate to the space between the axial surface of the drive and idler gears 40, 50 and the cover housing 30. This allows more lubricant to migrate to areas of the pump 10 that may be typically high-wear, and thus increase the efficiency and longevity of the pump 10. Testing has shown that drive gear tooth dimples 46 and idler gear tooth dimples 56 may reduce the energy requirement on a thirty amp motor by as much as five amps. It is contemplated that drive gear tooth dimples 46 and idler gear tooth dimples 56 may be fashioned on each axial surface of both the drive gear 40 and idler gear 50 in certain applications. Typically the drive and idler gears 40, 50 are configured so there is between two and four thousandths-of-an-inch play in the axial dimension between the drive and idler gears 40, 50 and the gear chamber 35. The dimples 46, 56 as shown herein are generally spherically shaped voids, but may have other shapes and/or configurations in embodiments of the pump 10 not pictured herein.

One embodiment of a rotary pump 80 is shown in FIG. 7A, which may also be used with various aspects of the pump 10 as disclosed and claimed herein. Rotary pumps 80 generally include a main body 20 and a rotary gear set 81, which includes at least one rotor gear 82 and a stator ring gear 84 surrounding each rotor gear 82. Two different embodiments of rotary gear sets 81 are shown in FIGS. 7B and 7C, respectively, both of which may be used with the embodiment of the main body 20 shown in FIG. 7A. The rotary gear set 81 shown in FIG. 7C includes rotor dimples 82*a* fashioned in the axial surface of the rotor gear 82 and stator dimples 84*a* fashioned in the axial surface of the stator ring gear 84. As with the drive and idler gears 40, 50 as explained above, the rotor and stator dimples 82*a*, 84*a* provide cavities into which lubricant may migrate during operation of the rotary pump 80. Pumps 10 other than gear or rotary pumps 80 as pictured and described herein may benefit from fashioning dimples in the rotating and/or stationary components of the pump, such as centrifugal pumps, peristaltic pumps, or any other type of pump 10 known to those skilled in the art. Accordingly, the dimpling method and/or structures as disclosed and claimed herein are not limited by the specific type of pump, pump system, and/or pump component that is configured with dimples.

Another embodiment of a rotary pump gear set 81 is shown in FIG. 7B. The rotor gear 82 as shown in FIG. 7B is fashioned with rotor grooves 83 in an axial surface thereof, and the stator ring gear 84 is fashioned with stator grooves 85 in an axial surface thereof. The rotor grooves 83 and stator grooves 85 cooperate to pressure balance the rotary pump 80 during operation as they facilitate cross flow of pressurized fluid from areas of high fluid volume (such as the bottom portion in FIG. 7B) to areas of low fluid volume (such as the top portion in FIG. 7B). Accordingly, a rotary pump 80 with a rotary pump gear set 81 fashioned with rotor and stator grooves 83, 85 will operate more smoothly and efficiently, and such a pump 10 will have increased longevity. Four rotor and stator grooves 83, 85 are shown in the embodiment pictured in FIG. 7B, but a lesser or greater number of rotor and/or stator grooves 83, 85 may be used in other embodiments of the rotary pump gear set 81 not pictured herein. Furthermore, although the rotor grooves 83 and stator grooves 85 are shown as being oriented at an angle of ninety degrees respective to the adjacent rotor grooves 83 and stator grooves 85, respectively, other orientations may be used depending on the number of rotor and/or stator grooves 83, 85 without departing from the spirit and scope of the pump system as disclosed and pump 10 as claimed herein.

The embodiments of the rotary pump gear set 81 shown in FIGS. 7B and 7C also include a plurality of stator radial bores 86 fashioned in the stator ring gear 84. Each stator radial bore 86 extends from the outer radial surface of the stator ring gear 84 (i.e., the surface of the stator ring gear 84 that interfaces the main body 20, as shown in FIG. 7A) to the inner radial surface thereof (i.e., the surface of the stator ring gear 84 that interfaces the rotor gear 82). The stator radial bores 86 may be positioned in the axial centerline of the stator ring gear 84. The stator radial bores 86 allow a predetermined amount (which amount is dependent at least on the cross-sectional area of the stator radial bores 86) of pressurized fluid from the rotary pump gear set 80 to flow from the area between the rotor gear 82 and stator ring gear 84 to the area between the stator ring gear 84 and the main body. Accordingly, the stator radial bores 86 constantly lubricate the rotary pump 80 with localized high pressure fluid, which increases the efficiency and longevity of a pump 10 so configured. The embodiments shown in FIGS. 7B and 7C include a total of four stator radial bores 86, wherein each stator radial bore 86 is oriented by ninety degrees with respect to adjacent stator radial bores 86. However, in embodiments not pictured herein, a different amount of stator radial bores 86 may be used and the orientation thereof may be different than shown in the embodiments pictured herein.

The pump 10, main body 20, cover housing 30, drive gear 40, idler gear 50, pressure relief assembly, rotary gear set 81, and various elements thereof may be constructed of any suitable material known to those skilled in the art. In the embodiment as pictured herein, it is contemplated that most elements will be constructed of metal or metallic alloys, polymers, or combinations thereof. However, other suitable materials may be used. Any spring 62 used in any embodiment may be constructed of any resilient material having the appropriate load characteristics. For example, rubber, polymer materials, metallic springs, or any other suitable material may be used for the spring 62.

It should be noted that the pump 10, main body 20, cover housing 30, drive gear 40, idler gear 50, pressure relief assembly, and rotary pump gear set 81 are not limited to the specific embodiments pictured and described herein, but is intended to apply to all similar apparatuses and methods for providing the various benefits of those elements. Modifications and alterations from the described embodiments will occur to those skilled in the art without departure from the spirit and scope of the pump 10, pressure relief assembly.

Furthermore, variations and modifications of the foregoing are within the scope of the pump 10 and/or pump system. It is understood that the pump 10 and pump system as disclosed and defined herein extends to all alternative combinations of two or more of the individual features mentioned or evident from the text and/or drawings. All of these different combinations constitute various alternative aspects of the pump 10 and/or pump system. The embodiments described herein explain the best modes known for practicing the pump 10 and/or pump system and will enable others skilled in the art to utilize the same. The claims are to be construed to include alternative embodiments to the extent permitted by the prior art.

The invention claimed is:

1. A pump comprising:

a. a main body, said main body comprising;
- i. a gear chamber;
- ii. a mounting base, wherein an outlet interface is formed on one surface of said mounting base, wherein a pump outlet port is positioned within the periphery of said outlet interface, and wherein the position of said pump is secured via said mounting base;
- iii. a cover housing interface surface;
- iv. a pump outlet passage fluidly connecting said gear chamber and said pump outlet port;
- v. a radial inlet port in fluid communication with said gear chamber;
- vi. a radial inlet port passage in fluid communication with said radial inlet port and said cover housing interface surface;

b. a cover housing attachable to said main body about said cover housing interface surface, said cover housing comprising;
- i. an inlet channel;
- ii. an axial inlet port in fluid communication with said inlet channel;
- iii. a radial inlet port feed passage in fluid communication with said inlet channel and said radial inlet port passage; and c. a drive gear and an idler gear disposed in said gear chamber, wherein said drive gear and idler gear are intermeshed, wherein a source of rotational power is operatively coupled to said drive gear, wherein said axial inlet port in said cover housing is oriented to oppose an axial face of said drive gear and said idler gear such that a fluid is supplied directly to said axial face of said drive gear and said idler year via said axial inlet port, and wherein said radial inlet port feed passage is in fluid communication with a radial face of said drive gear and said idler gear.

2. The pump according to claim 1 wherein said main body further comprises a drive gear shaft bore, wherein an interface of said drive gear shaft bore and said gear chamber is configured as a chamfer relief.

3. The pump according to claim 2 wherein said drive gear shaft bore comprises a drive gear shaft bore groove.

4. The pump according to claim 1 wherein said main body further comprises at least one oil feed drive gear trough.

5. The pump according to claim 1 wherein said main body further comprises at least one oil feed idler gear trough.

6. The pump according to claim 1 wherein said cover housing further comprises:

a. a pressure relief channel in fluid communication with a pressurized fluid in said gear chamber;

b. a pressure relief outlet in fluid communication with said pressure relief channel; and c. a valve, wherein said valve restricts passage of said pressurized fluid from said pressure relief channel to said pressure relief outlet.

7. The pump according to claim 6 further comprising a spring positioned in said pressure relief channel, wherein said spring biases said valve against said pressurized fluid located in said pressure relief channel.

8. The pump according to claim 7 wherein said pump is further defined as being specifically configured for use in an internal combustion engine.

9. A pump comprising:

a. a main body comprising:
- i. a gear chamber;
- ii. a mounting base, wherein an outlet interface is formed on one surface of said mounting base, wherein a pump outlet port is positioned within the periphery of said outlet interface, and wherein the position of said pump is secured via said mounting base;
- iii. a cover housing interface surface;
- iv. a pump outlet passage fluidly connecting said gear chamber and said pump outlet port;
- v. a radial inlet port in fluid communication with said gear chamber; and,
- vi. a radial inlet port passage in fluid communication with said radial inlet port and said cover housing interface surface;

b. a dual-relief cover housing configured to be secured to said housing about said cover housing interface surface, said dual relief cover housing comprising:
- i. a first pressure relief channel in fluid communication with said pump outlet passage;
- ii. a second pressure relief channel, wherein said first pressure relief channel and said second pressure relief channel are in fluid communication with a pressurized fluid within said pump by a pressure relief inlet in combination with a cross channel, and wherein the cross-sectional area of said second pressure relief channel is between five and ninety five percent larger than that of said first pressure relief channel;
- iii. a first pressure relief assembly positioned in said first pressure relief channel;
- iv. a second pressure relief assembly positioned in said second pressure relief channel, wherein said first pressure relief assembly is configured to allow said pressurized fluid within said pump to actuate said first pressure relief assembly at a lower pressure than required for said second pressure relief assembly;
- v. a main body interface surface integrally configured to abut said cover housing interface surface of said main body;
- vi. an inlet channel;
- vii. an axial inlet port in fluid communication with said inlet channel;
- viii. a radial inlet port feed passage in fluid communication with said inlet channel and said radial inlet port passage;

c. a set of gears rotatable with respect to said main body and disposed within said gear chamber, said set of gears comprising:
- i. a drive gear having a plurality of drive gear teeth;
- ii. a drive gear shaft affixed to said drive gear;
- iii. an idler gear having a plurality of idler gear teeth;

iv. an idler gear shaft associated with said idler gear, wherein said axial inlet port in said dual-relief cover housing is oriented to oppose an axial face of said drive gear and said idler gear such that a fluid is supplied directly to said axial face of said drive gear and said idler gear via said axial inlet port, and wherein said radial inlet port feed passage is in fluid communication with a radial face of said drive gear and said idler gear.

10. The pump according to claim 9 wherein said dual-relief cover housing further comprises a pressure relief inlet cavity in said main body interface surface, wherein said pressure relief inlet cavity is in fluid communication with said first pressure relief channel.

11. The pump according to claim 10 wherein said dual relief cover housing further comprises a lubricating trough adjacent said pressure relief inlet cavity.

* * * * *